US005096566A

United States Patent [19]

Dawson et al.

[11] Patent Number: 5,096,566

[45] Date of Patent: Mar. 17, 1992

[54] PROCESS FOR REDUCING THE VISCOSITY OF HEAVY HYDROCARBON OILS

[75] Inventors: William H. Dawson, Kanata; Esteban Chornet, Sherbrooke; Ralph P. Overend, Ottawa; Amitabha Chakma, Sherbrooke; Jean-Pierre Lemonnier, North Hatley, all of Canada

[73] Assignee: Her Majesty the Queen in right of Canada, as represented by the Minister of Energy, Mines and Resources, Ottawa, Canada

[21] Appl. No.: 622,616

[22] Filed: Feb. 11, 1991

Related U.S. Application Data

[63] Continuation of Ser. No. 414,302, Sep. 29, 1989, abandoned.

[30] Foreign Application Priority Data

Oct. 4, 1988 [CA] Canada ..... 579316

[51] Int. Cl.[5] ..... C10G 9/00

[52] U.S. Cl. ..... 208/106; 208/107; 208/157

[58] Field of Search ..... 208/106, 107, 157

[56] References Cited

U.S. PATENT DOCUMENTS

| | | | |
|---|---|---|---|
| 3,071,540 | 1/1963 | McMahon et al. | 208/163 |
| 3,152,065 | 10/1964 | Sharp et al. | 208/157 |
| 3,654,140 | 4/1972 | Griffel et al. | 208/157 |
| 3,717,438 | 2/1973 | Schmalfeld et al. | 23/262 |
| 3,767,564 | 10/1973 | Youngblood et al. | 208/92 |
| 4,405,444 | 9/1983 | Zandona | 208/113 |
| 4,410,414 | 10/1983 | Briley | 208/107 |
| 4,520,224 | 5/1985 | Kamimura et al. | 585/648 |
| 4,555,328 | 11/1985 | Krambeck et al. | 208/157 |
| 4,793,913 | 12/1988 | Chessmore et al. | 208/157 |
| 4,875,996 | 10/1989 | Hsieh et al. | 208/157 |

*Primary Examiner*—Anthony McFarlane
*Attorney, Agent, or Firm*—Fish & Richardson

[57] ABSTRACT

A process is described for reducing the viscosity of heavy hydrocarbon oils which comprises separately heating a stream of heavy hydrocarbon oil and a stream of gas, mixing the hot gas and hot heavy hydrocarbon oil under pressure and immediately thereafter passing the heavy oil/gas mixture through a small nozzle or orifice such that a substantial pressure drop occurs across the orifice and the heavy oil/gas mixture is ejected from the orifice as a spray in the form of fine oil droplets entrained by highly turbulent gas flow. This spray is discharged into a confined reaction zone from which the oil of reduced viscosity is collected.

8 Claims, 1 Drawing Sheet

PROCESS FOR REDUCING THE VISCOSITY OF HEAVY HYDROCARBON OILS

This application is a continuation of Ser. No. 07/414,302, filed Sept. 29, 1989, now abandoned.

BACKGROUND OF THE INVENTION

This invention relates to the treatment of heavy hydrocarbon oils and, more particularly, to an inexpensive process for reducing the viscosity of such oils.

Heavy hydrocarbon oils are typically oils which contain a large proportion, usually more than 50% by weight, of material boiling above 524° C. equivalent atmospheric boiling point. Large quantities of such heavy oils are available in heavy oil deposits in Western Canada and heavy bituminous oils extracted from oil sands. Other sources of heavy hydrocarbon oils can be such materials as atmospheric tar bottoms products, vacuum tar bottoms products, heavy cycle oils, shale oils, coal-derived liquids, crude oil residua, topped crude oils, etc.

As the reserves of conventional crude oils decline, there is an increasing interest in processes for upgrading these heavy oils. However, one of the major difficulties in the processing of heavy crude oils is that they are exceedingly viscous and difficult to pump through pipelines.

Heavy oils of the above type can be considered as having both macro and micro structural properties as well as having chemical constitutive molecules. The latter are generally classified as belonging to two distinct categories, namely maltenes (soluble in 40 volumes of pentane) and as asphaltenes (soluble in toluene but insoluble in pentane). The spatial organization of maltenes and asphaltenes results in the macro and micro structural properties, with the macromolecular organization causing the high viscosities which are such a great problem in transportation of these oils. In fact, the high viscosity of heavy oils normally necessitates the addition of a diluent before they can be transported through pipelines. The costs of the diluent, the additional costs of transporting the diluent and the costs of later removing the diluent greatly increase the total cost of processing heavy hydrocarbon oils.

At the molecular level, the asphaltenes are formed by polynuclear aromatic molecules to which are attached alkyl chains. These asphaltene unit molecules are grouped in layers having several unit molecules, typically 5 or 6, surrounded by or immersed within the maltene fluid. The latter can be conveniently considered as being composed of free saturates, mono and diaromatics and resins which are believed to be associated with the asphaltenes. This organization is considered to be the microstructure and the layers of asphaltenes can be considered as a microcrystalline arrangement. The above microstructural organization forms aggregates in which several microcrystallites arrange themselves together to form a so-called micellar structure which is also known as a macrostructure. This micellar structure exhibits very strong associative and cohesive forces between the aggregates and this induces the troublesome high viscosities, since the heavy oil behaves more as a sol/gel system than as a free flowing liquid.

Normally very high processing temperatures are required to break the very strong associative forces between the micell components and such high temperatures typically result in extensive modification of the constitutive molecules, e.g. dealkylation and cracking, leading to the formation of coke precursors and, inevitably, to coke formation (toluene insoluble carbonaceous material). It is an object of the present invention to develop a simplified process which will successfully break up the micellar structure without requiring the high temperatures which cause coke formation.

SUMMARY OF THE INVENTION

According to the present invention it has been found that the viscosity of heavy hydrocarbon oils can be substantially reduced by separately preheating a stream of heavy hydrocarbon oil and a stream of gas, then mixing the hot gas and hot heavy hydrocarbon oil under pressure and immediately thereafter passing the heavy oil/gas mixture through a nozzle or orifice such that a substantial pressure drop occurs across the orifice and the heavy oil/gas mixture is ejected from the orifice in the form of fine oil droplets entrained by highly turbulent gas flow. The discharge from the orifice enters a reaction zone where the reaction is completed. A very strong shearing action is created as the heavy oil and gas are forced under pressure through the orifice and this together with a sudden decompression through the orifice appears to destroy the micellar arrangement and the asphaltene microcrystallites separate from each other.

The key factors in obtaining the required viscosity reduction are related to the pressure drop across the nozzle or orifice and the flows through the opening for a given configuration of the nozzle. The decompression must result in high shear ratio to effectively break up the micellar structure heavy oil. This requires the proper combination of pressure, gas and liquid flows and temperature. The temperature is important in providing sufficient molecular mobility to result in desired viscosity reduction.

Figure 1:
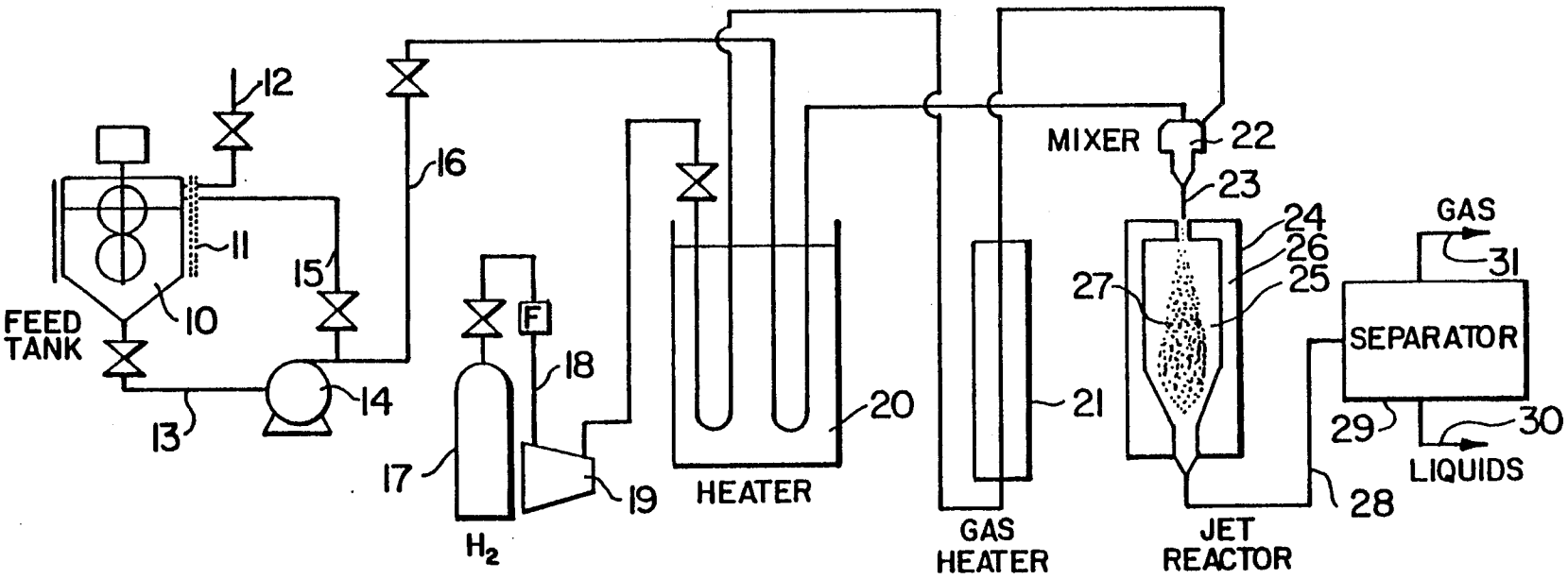
FIG. 1 is a simplified flow chart of this invention.

In order to achieve the desired viscosity reduction, the heavy hydrocarbon oil is preferably heated to a temperature of about 350° to 450° C. prior to entering the mixer, while the gas is preferably heated to a temperature of about 400° to 900° C. prior to entering the mixer. The pressure in the mixer should be raised to a level such as to permit a decompression across the orifice of at least 500 to 1500 psi, preferably 1,000 to 1,200 psi. Typically the pressure in the mixer is 700 to 2,000 psi.

DESCRIPTION OF THE PREFERRED EMBODIMENTS

In order to achieve the desired viscosity reduction, the heavy hydrocarbon oil is preferably heated to a temperature of about 350° to 450° C. prior to entering the mixer, while the gas is preferably heated to a temperature of about 400° to 900° C. prior to entering the mixer. The pressure in the mixer should be raised to a level such as to permit a decompression across the orifice of at least 500° to 1500° psi, preferably 1,000° to 1,200° psi. Typically the pressure in the mixer is about 700° to 2,000° psi.

In order to achieve the desired shearing action and decompression, each nozzle or orifice preferably has a diameter of from 0.1 to 1.0 mm. With such orifice and the above temperature and pressure conditions, the effluent from the orifice is in the form of very fine oil droplets in the order of 5 to 50 microns average diameter. These very small droplets are entrained by the highly turbulent gas jet discharging from the orifice and into the reaction vessel. The residence time within the reaction vessel is short, in the order of 1 to 10 seconds, and most of the viscosity reducing activity has occurred by the time the droplets emerge from the orifice.

At some distance from the nozzle, part of the gas jet hits the reactor wall, causing coalescence of liquid droplets and inducing a wall flow.

The gaseous component is preferably hydrogen so that some hydrogenation will occur during the reaction, but highly successful visbreaking can be achieved with the process of this invention using an inert gas such as nitrogen. In order to provide very fine oil droplets, which is a measure of the shearing action, a high gas/-liquid ratio is required, preferably about 90 liters per minute gas flow (measured at standard temperature and pressure) and 0.1 liter/min.

The invention will be more easily understood in conjunction with the following diagrams and examples, which are given by way of illustration, but are in no way restrictive.

The device according to FIG. 1 comprises a feed tank 10 for receiving heavy oil 12. It may include a heating jacket 11 for heating the heavy oil to make it pumpable. This heavy oil is then drawn off through line 13 and through feed pump 14 to outlet line 16. A recycle loop 15 may be included between outlet line 16 and feed tank 10.

The heavy oil is then pumped in line 16 through heating vessel 20 and into mixer 22. The gaseous component, e.g. hydrogen or inert gas, is stored at 17 and this is fed via line 18 to a compressor where the pressure is raised to the desired level. This pressurized gas then continues through heater 20 and a secondary heater 21 before entering the mixer 22. The oil/gas mixture ejects through nozzle or orifice into a reactor vessel 24 having a reaction zone 25 and heating coils 26. The mixture ejects into the reaction zone 25 in the form of a spray 27 of fine oil droplets and gas. The heating coils 26 serve to maintain reaction temperature, but care must be taken not to overheat the reactor wall as this may induce coke formation in the bitumen flowing along the wall. The visbroken product is then discharged through line and into separator 29 where the product is separated into a gaseous fraction 31 and a liquid fraction 30. This separator is maintained at a temperature of about 220° to 240° C. and the liquid stream 30 may be collected in a collection vessel while the gas stream 31 is preferably cooled to room temperature with the condensate being Further preferred embodiments of this invention are illustrated by the following non-limiting examples.

EXAMPLE 1

A visbreaking experiment was carried out using an apparatus of the type shown in FIG. 1. An Athabasca coker feedstock was used having the following properties:

| | |
|---|---|
| API gravity: | 10.1 |
| Density: | 0.999 |
| Viscosity 20° C. (cp) | 70,000 |
| Ramsbottom Carbon residue (wt %) | 12.7 |
| Ash (wt %) | 0.48 |
| Carbon (wt %) | 83.77 |
| Hydrogen (wt %) | 10.51 |
| Nitrogen (wt %) | 0.37 |
| Sulphur (wt %) | 4.75 |

-continued

| | |
|---|---|
| Oxygen (wt %) | 0.88 |
| Vanadium (ppm wt.) | 200 |
| Nickel (ppm wt.) | 75.5 |
| Asphaltenes (wt %) | 15.2 |

This bitumen feedstock, having an initial viscosity of 70,000 cp, was fed into the feed tank of the visbreaker as described in FIG. 1 and was heated to about 150° C. with stirring. This warmed bitumen was then pumped through heater 20 where the temperature was raised to about 400° C. and this hot bitumen was then fed into mixer 22. This hot bitumen may be passed through a screen filter before entering the mixing chamber.

Hydrogen was compressed to about 1,300 psi and heated to about 500° C. by being passed through two heaters in series. This hot, pressurized hydrogen was passed into the mixer and mixed with the hot bitumen. These were mixed in a ratio of a gas flow rate of about 90 LSTP/min with a bitumen flow rate of about 0.1 liter/min.

The hot mixture of bitumen and hydrogen at a pressure of about 1,300 psi was passed though an orifice having a diameter of about 0.2 mm. The mixture was passed though the orifice at near sonic velocities, resulting in a high shearing action and the formation of fine bitumen droplets having an average diameter of about 30 microns. A pressure drop of about 1,000 psi occurred across the orifice and the emerging droplets were entrained by the highly turbulent gas flow into the reactor. The residence time within the reaction vessel was about 1–3 seconds and the product obtained had a viscosity of only 170 cp. Hydrocarbon gas production was 5 wt % and the asphaltene concentration in the product was 10 wt %. No coke was formed.

Having thus generally and specifically described the process of this invention, it is to be understood that minor variations may be made thereof without departing from the scope except as defined by the claims below.

We claim:

1. A process for reducing the viscosity of heavy hydrocarbon oils which comprises separately heating a feed stream of heavy hydrocarbon oil to a temperature of 350°–450° C. and a stream of gas to a temperature of 400°–900° C., mixing the heated gas and heated heavy hydrocarbon oil under pressure and immediately thereafter passing the heavy oil/gas mixture at a pressure of 700–2000 psi through a small orifice such that a pressure drop of 500–1500 psi occurs across the orifice and the heavy oil/gas mixture is ejected from the orifice into a confined reaction zone as a spray in the form of fine oil droplets entrained by highly trubulent gas flow, thereby providing an oil of reduced viscosity relative to the heavy hydrocarbon oil feed without substantial coke formation.

2. A process according to claim 1 wherein the heavy hydrocarbon oil contains more than 50% by weight of material boiling above 524° C.

3. A process according to claim 2 wherein the heavy hydrocarbon oil is bitumen.

4. A process according to claim 3 wherein the ga is an inert gas.

5. A process according to claim 3 wherein the gas is hydrogen.

6. A process according to claim 1 wherein the pressure drop across the orifice is about 1,000 to 1,200 psi.

7. A process according to claim 6 wherein the orifice has a diameter of about 0.1 mm.

8. A process according to claim 7 wherein oil droplets are formed having diameters in the range of 5 to 50 microns.

* * * * *